US009046028B2

(12) United States Patent
Yasoshina

(10) Patent No.: US 9,046,028 B2
(45) Date of Patent: Jun. 2, 2015

(54) MUFFLER EQUIPPED WITH CATALYTIC CONVERTER

(71) Applicant: Honda Motor Co., Ltd., Tokyo (JP)

(72) Inventor: Sayaka Yasoshina, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/190,136

(22) Filed: Feb. 26, 2014

(65) Prior Publication Data

US 2014/0251717 A1 Sep. 11, 2014

(30) Foreign Application Priority Data

Mar. 11, 2013 (JP) ..... 2013-047812

(51) Int. Cl.

| | |
|---|---|
| ***F01N 13/10*** | (2010.01) |
| ***F01N 3/10*** | (2006.01) |
| ***F01N 1/02*** | (2006.01) |
| ***F01N 13/08*** | (2010.01) |
| ***F01N 1/08*** | (2006.01) |
| ***F01N 1/10*** | (2006.01) |
| *F01N 13/00* | (2010.01) |
| *F01N 3/08* | (2006.01) |
| *F01N 1/00* | (2006.01) |

(52) U.S. Cl.

CPC ..... *F01N 13/08* (2013.01); *F01N 1/003* (2013.01); *F01N 1/083* (2013.01); *F01N 1/089* (2013.01); *F01N 1/10* (2013.01); *F01N 2230/04* (2013.01); *F01N 2470/02* (2013.01); *F01N 2490/08* (2013.01)

(58) Field of Classification Search

CPC ..... F01N 1/02; F01N 1/04; F01N 1/081; F01N 1/082; F01N 3/06; F01N 3/08; F01N 3/10

USPC ..... 181/240, 231, 258, 227, 228, 268, 272, 181/275; 60/299, 314, 322, 312

See application file for complete search history.

(56) References Cited

U.S. PATENT DOCUMENTS

| | | | | |
|---|---|---|---|---|
| 4,854,417 | A * | 8/1989 | Uesugi et al. | 181/272 |
| 4,867,270 | A * | 9/1989 | Wissmann et al. | 181/231 |
| 4,890,690 | A * | 1/1990 | Fischer et al. | 181/240 |
| 5,338,903 | A * | 8/1994 | Winberg | 181/231 |
| 5,732,555 | A * | 3/1998 | Gracyalny et al. | 60/299 |

(Continued)

FOREIGN PATENT DOCUMENTS

JP 3237333 B2 12/2001

*Primary Examiner* — Edgardo San Martin

(74) *Attorney, Agent, or Firm* — Westerman, Hattori, Daniels & Adrian, LLP

(57) ABSTRACT

A muffler is equipped with a catalytic converter and is compact and capable of stably supporting the catalytic converter disposed in a muffler box with a single partition. The muffler box is formed by joining outer peripheral ends of three parts which are first and second box halves with open surfaces thereof abutting each other and a partition interposed between the first and second box halves. A first silencing chamber communicating with an exhaust inlet pipe is defined between the first box half and the partition and a second silencing chamber communicating with a tailpipe is defined between the second box half and the partition. A pair of supporting bosses protruding toward the first and second silencing chambers, respectively, are formed in the partition, and the supporting bosses support a holding tube of the catalytic converter communicating between the first and second silencing chambers.

9 Claims, 5 Drawing Sheets

(56) References Cited

U.S. PATENT DOCUMENTS

| | | | | |
|---|---|---|---|---|
| 6,341,662 | B1 * | 1/2002 | Karlsson | 181/230 |
| 6,393,835 | B1 * | 5/2002 | Stoll et al. | 60/299 |
| 6,422,338 | B1 * | 7/2002 | Menzel et al. | 181/230 |
| 6,789,644 | B2 * | 9/2004 | Mukaida | 181/272 |
| 6,955,043 | B2 * | 10/2005 | Schlossarczyk et al. | 60/299 |
| 7,296,657 | B2 * | 11/2007 | Ohno et al. | 181/272 |
| 7,407,036 | B2 * | 8/2008 | Kobayashi et al. | 181/240 |
| 7,854,296 | B2 * | 12/2010 | Saunders et al. | 181/240 |
| 7,896,127 | B2 * | 3/2011 | Sato et al. | 181/240 |
| 8,136,350 | B2 * | 3/2012 | Duch et al. | 60/299 |
| 8,336,301 | B2 * | 12/2012 | Werni et al. | 60/297 |
| 2009/0013673 | A1 * | 1/2009 | Mukaida | 60/299 |
| 2014/0251718 | A1 * | 9/2014 | Yasoshina | 181/211 |

* cited by examiner

MUFFLER EQUIPPED WITH CATALYTIC CONVERTER

CROSS REFERENCES TO RELATED APPLICATIONS

The present application claims priority under 35 U.S.C. §119 to Japanese Patent Application No. 2013-047812, filed Mar. 11, 2013, entitled "Muffler Equipped with Catalytic Converter". The contents of this application are incorporated herein by reference in their entirety.

TECHNICAL FIELD

The present disclosure relates to an improvement of a muffler equipped with a catalytic converter which includes: a muffler box; an exhaust inlet pipe provided to the muffler box and connected to an exhaust pipe of an engine; a tailpipe provided to the muffler box and opened to atmosphere; and a catalytic converter disposed in an exhaust path inside the muffler box, the exhaust path communicating between the exhaust inlet pipe and the tailpipe.

DESCRIPTION OF THE RELATED ART

Such a muffler equipped with a catalytic converter is known as disclosed in, for example, Japanese Patent No. 3237333.

SUMMARY

This conventional type of muffler equipped with a catalytic converter includes a pair of partitions arranged with a gap therebetween so as to stably support the catalytic converter inside a muffler box. These partitions increase a size of the muffler. This increase in the size of the muffler is not preferable because it also increases a likelihood of the muffler interfering with other components, especially in a case of a general-purpose engine mounted on various kinds of work machines.

The present disclosure has been made in view of the above circumstance, and it is preferable to provide a compact muffler equipped with a catalytic converter capable of stably supporting the catalytic converter in a muffler box with a single partition.

In order to achieve this, according to a first aspect of the present disclosure, there is provided a muffler equipped with a catalytic converter, comprising: a muffler box; an exhaust inlet pipe provided to the muffler box and connected to an exhaust pipe of an engine; a tailpipe provided to the muffler box and opened to atmosphere; and a catalytic converter disposed in an exhaust path inside the muffler box, the exhaust path communicating between the exhaust inlet pipe and the tailpipe, wherein the muffler box is formed by joining outer peripheral ends of three parts which are first and second box halves with open surfaces thereof abutting each other and a partition interposed between the first and second box halves, a first silencing chamber communicating with the exhaust inlet pipe is defined between the first box half and the partition, a second silencing chamber communicating with the tailpipe is defined between the second box half and the partition, a pair of supporting bosses protruding toward the first and second silencing chambers, respectively, and arranged with a gap between the supporting bosses are formed in the partition, and the supporting bosses support a holding tube of the catalytic converter communicating between the first and second silencing chambers.

According to the first aspect of the present disclosure, the muffler box is formed by joining the outer peripheral ends of the three parts which are the first and second box halves with the open surfaces thereof abutting each other and the partition interposed between the first and second box halves, the first silencing chamber communicating with the exhaust inlet pipe is defined between the first box half and the partition, the second silencing chamber communicating with the tailpipe is defined between the second box half and the partition, the pair of supporting bosses protruding toward the first and second silencing chambers, respectively, and arranged with a gap between the supporting bosses are formed in the partition, and the supporting bosses support the holding tube of the catalytic converter communicating between the first and second silencing chambers. Thus, the catalytic converter can be stably supported in the muffler box with the single partition. Accordingly, the muffler equipped with a catalytic converter can be made compact.

According to a second aspect of the present disclosure, in addition to the first aspect, the partition includes a pair of partition plates closely contacting each other at outer peripheral portions thereof, and the pair of supporting bosses are formed in the partition plates, respectively.

According to the second aspect of the present disclosure, the partition includes the pair of partition plates closely contacting each other at outer peripheral portions thereof, and the pair of supporting bosses are formed in the partition plates, respectively. Thus, each of the supporting bosses can be molded easily when the corresponding partition plate is a single separated body. Accordingly, moldability is good. In addition, by joining the holding tube of the catalytic converter to the supporting bosses of both partition plates, the outer peripheral portions of the both partition plates closely contact each other and form a single partition, and this single partition can be easily held and joined between the first and second box halves. Accordingly, the manufacturability is improved.

According to a third aspect of the present disclosure, in addition to the first or second aspect, bulging portions bulging toward the first and second silencing chambers, respectively, and defining a third silencing chamber between the bulging portions are formed in the pair of partition plates, respectively, one of the bulging portions is provided with a plurality of silencing holes communicating between the second and third silencing chambers, and an inner end of the tailpipe is opened to the third silencing chamber.

According to the third aspect of the present disclosure, the bulging portions bulging toward the first and second silencing chambers, respectively, and defining the third silencing chamber between the bulging portions are formed in the pair of partition plates, respectively, the one of the bulging portions is provided with the many silencing holes communicating between the second and third silencing chambers, and the inner end of the tailpipe is opened to the third silencing chamber. Accordingly, it is easy to additionally provide the third silencing chamber between the second silencing chamber and the tailpipe and to enhance silencing effect.

According to a fourth aspect of the present disclosure, in addition to any one of the first to third aspects, flame arresters are attached to opposite end portions of the holding tube of the catalytic converter, the flame arresters facing each other with a catalyst in the catalytic converter situated between the flame arresters.

According to the fourth aspect of the present disclosure, the flame arresters are attached to opposite end portions of the holding tube of the catalytic converter, the flame arresters facing each other with the catalyst in the catalytic converter situated between the flame arresters. Thus, even if a flame is generated in the catalyst due to an exhaust gas purifying reaction, the flame arresters can keep the flame within the catalytic converter.

According to a fifth aspect of the present disclosure, in addition to any one of the first to fourth aspects, secondary air supplied into any one of the exhaust pipe and the exhaust inlet pipe is mixed with exhaust gas in the first silencing chamber so as to facilitate an exhaust gas purifying reaction in the catalytic converter.

According to the fifth aspect of the present disclosure, the secondary air supplied into any one of the exhaust pipe and the exhaust inlet pipe is mixed with the exhaust gas in the first silencing chamber so as to facilitate the exhaust gas purifying reaction in the catalytic converter. Thus, the secondary air is well mixed with the exhaust gas in the first silencing chamber and then supplied to the catalyst. Accordingly, the purifying reaction in the catalyst can be facilitated effectively.

The above and other objects, characteristics and advantages of the present disclosure will be clear from detailed descriptions of the preferred embodiment which will be provided below while referring to the attached drawings.

DESCRIPTION OF THE PREFERRED EMBODIMENT

An embodiment of the present invention will be described below based on the attached drawings.

Figure 1:
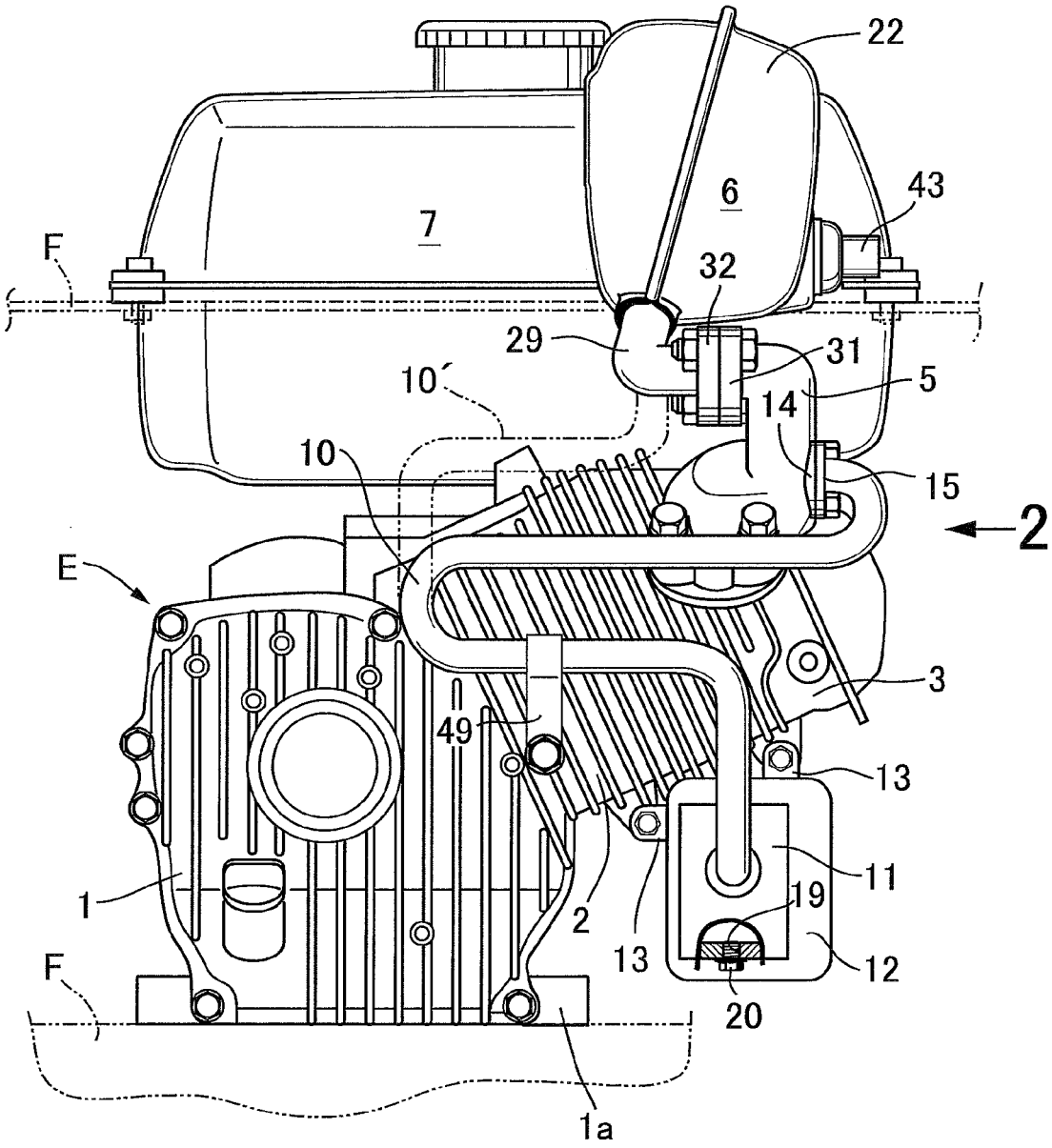
FIG. 1 is a side view of a general-purpose engine according to an embodiment of the present disclosure.
Figure 2:
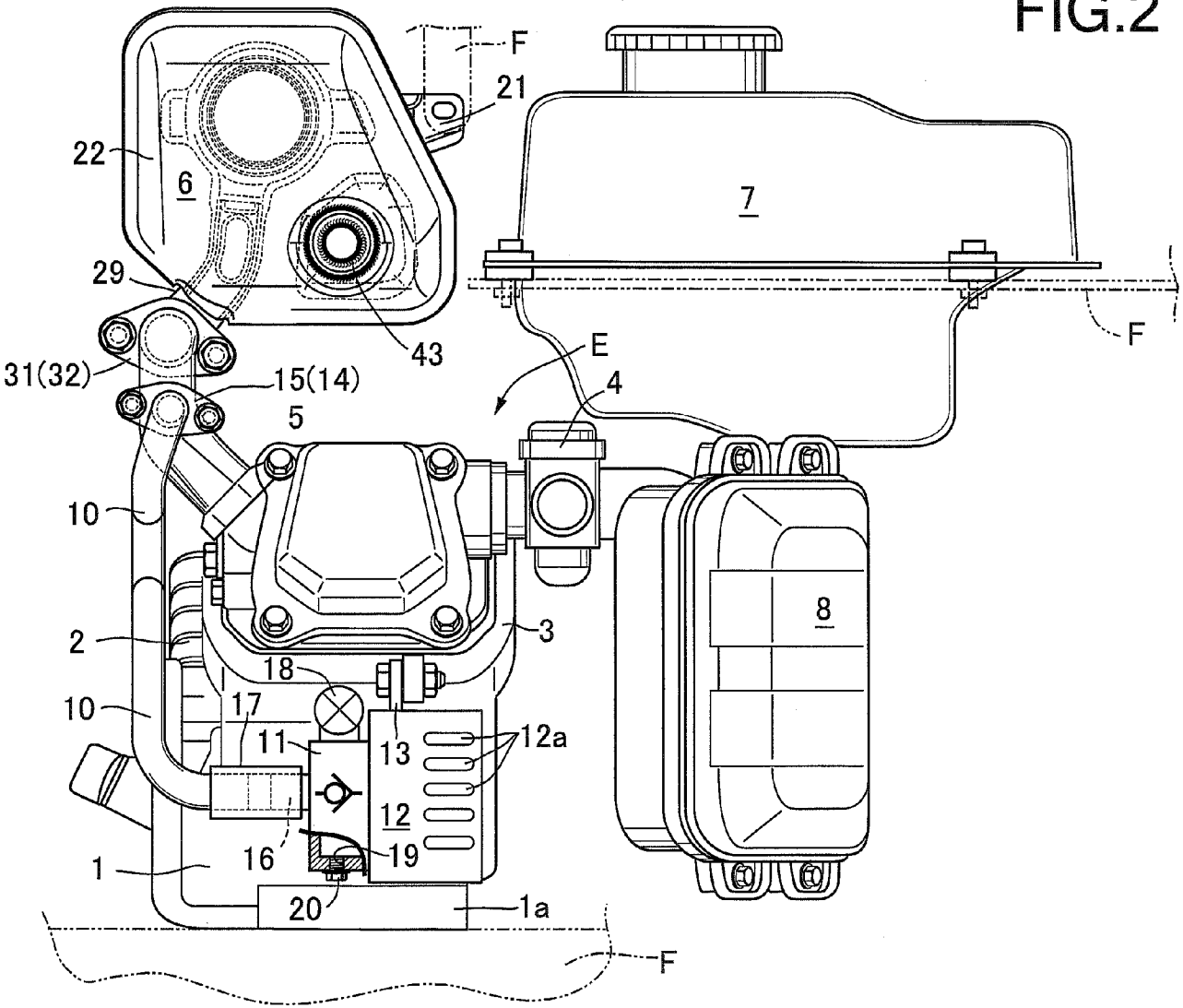
FIG. 2 is a view from an arrow 2 in FIG. 1.

First, referring to FIGS. 1 and 2, a general-purpose engine E for driving generators and other various work machines includes: a crankcase 1 having a mount flange 1*a* at a lower end thereof; a cylinder block 2 provided continuously on an upper portion of this crankcase 1 and tilting toward one lateral side of the crankcase 1; and a cylinder head 3 provided continuously on an upper end of this cylinder block 2. A carburetor 4 is attached to one side surface of the cylinder head 3 at which an intake port is opened, and an air cleaner 8 which filters intake air into the engine E is connected to an air inlet of this carburetor 4. The mount flange 1*a* mentioned above is attached on a work machine's frame F supporting the engine E.

Moreover, a muffler 6 is connected through an exhaust pipe 5 to another side surface of the cylinder head 3 at which an exhaust port is opened, and this muffler 6 is disposed immediately above the cylinder head 3 and the cylinder block 2. Furthermore, a fuel tank 7 supported by the work machine's frame F is disposed on one lateral side of the muffler 6 and immediately above the air cleaner 8.

A downstream end of a secondary-air introducing pipe 10 is connected to the exhaust pipe 5, and an exclusive air filter 12 is connected to an upstream end of this secondary-air introducing pipe 10 via a one-way valve 11. An intermediate portion of the secondary-air introducing pipe 10 is held by a pipe holder 49 attached to the cylinder block 2.

The air filter 12 is fixed by bolting a pair of brackets 13 thereof to the cylinder block 2 and the cylinder head 3, and is disposed in a space between the crankcase 1 of the engine E and a lower surface of the cylinder block 2 of the engine E. This air filter 12 is configured such that its air inlets 12*a* face in the same direction as an exhaust outlet in a tailpipe 43 of the muffler 6.

The one-way valve 11 is formed of a reed valve which responds sensitively to exhaust pulsation, and closes when receiving positive pressure of the exhaust pulsation of the engine E and opens when receiving negative pressure of the exhaust pulsation. This one-way valve 11 is attached to one sidewall of the air filter 12.

A connection flange 14 having a secondary-air inlet is connected integrally to an intermediate portion of the exhaust pipe 5, the secondary-air inlet communicating with an inside of the intermediate portion. The secondary-air introducing pipe 10 is made of copper, has a connection flange 15 at the downstream end thereof, which is bolted to the connection flange 14, and is disposed in such a way as to meander over one side surface of each of the cylinder head 3 and the cylinder block 2, thereby maximizing a pipe length of the secondary-air introducing pipe 10. The upstream end of this secondary-air introducing pipe 10 is connected to an outlet pipe 16 of the one-way valve 11 via a rubber tube 17. Since the rubber tube 17 is used as a joint, the secondary-air introducing pipe 10 can be connected to the one-way valve 11 easily.

A temperature sensor 18 is provided to the one-way valve 11 or in a vicinity thereof, the temperature sensor 18 configured to detect when ambient temperature reaches or exceeds a predetermined value and stop an operation of the engine E. Moreover, the one-way valve 11 has a drain port 19 for discharging, to an outside, droplets of water resulting from condensation on and running down an inner wall of the secondary-air introducing pipe 10. The drain port 19 is normally closed by a drain bolt 20. Moreover, each section of the meandering secondary-air introducing pipe 10 is disposed laterally or inclined downward so that the droplets of water resulting from condensation on the inner wall do not stay there.

Next, a structure of the muffler 6 will be described with reference to FIGS. 2 to 4.

Figure 3:
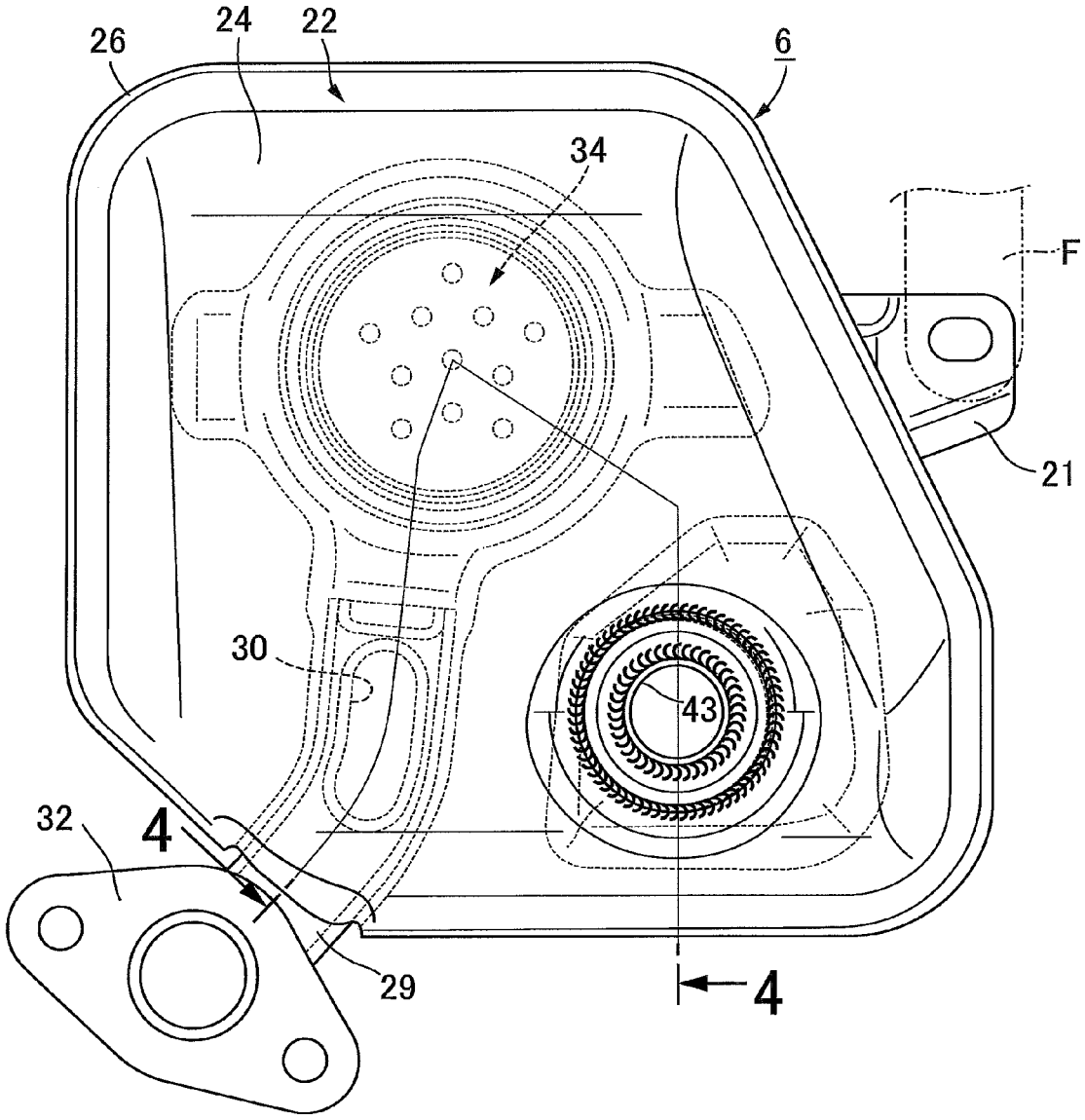
FIG. 3 is an enlarged view of a muffler in FIG. 2.
Figure 4:
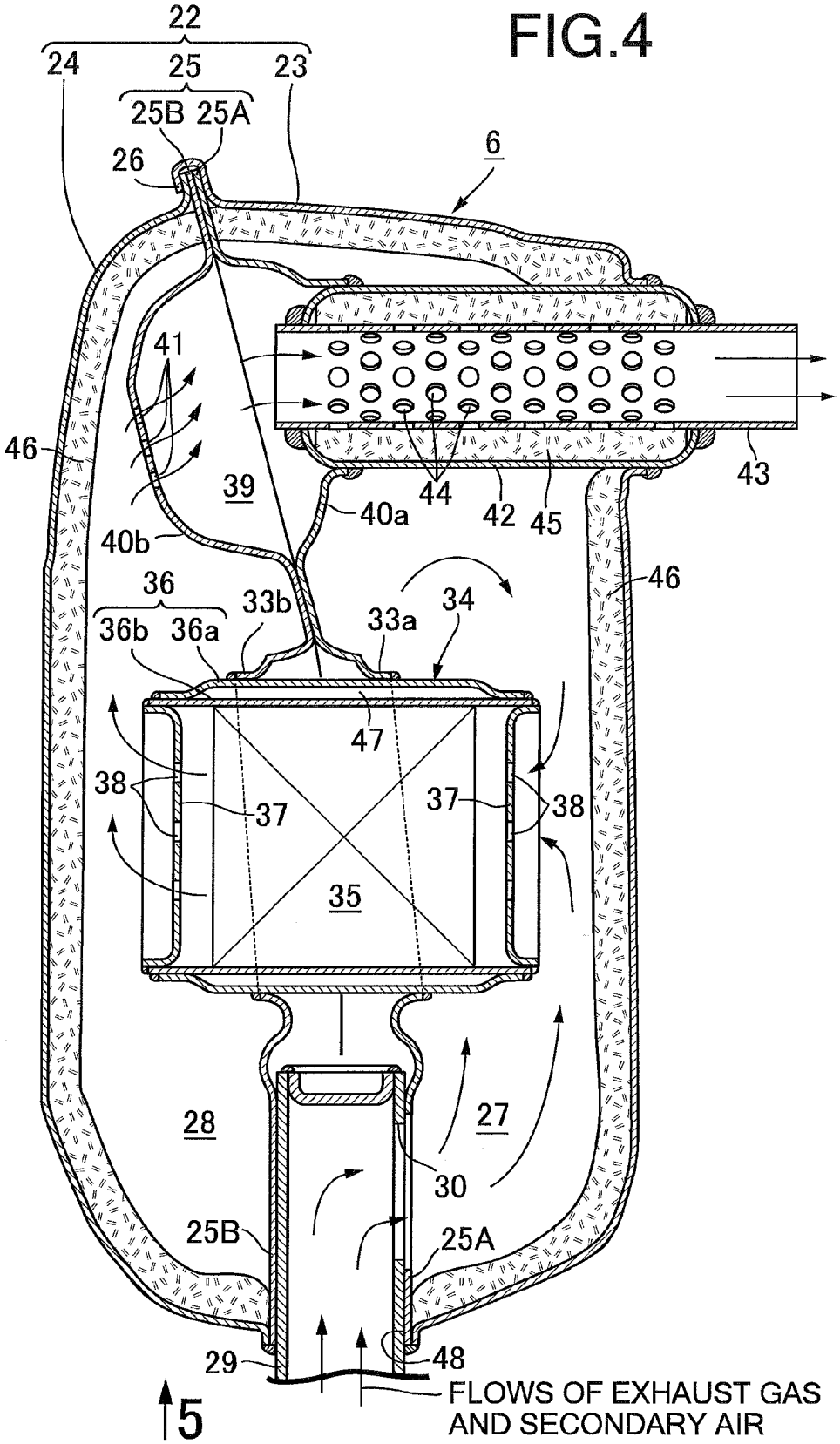
FIG. 4 is a sectional view taken along a line 4-4 in FIG. 3.

As shown in FIGS. 2 and 3, the muffler 6 is fixed by bolting a bracket 21 to the work machine's frame F, the bracket 21 being welded to a side surface of the muffler 6. In FIGS. 3 and 4, a muffler box 22 being a main part of the muffler 6 is formed by swaging and joining three parts which are first and second box halves 23, 24 with their open surfaces abutting each other and a single partition 25 held between these first and second box halves 23, 24. A swaging piece 26 used for the swaging and joining is formed in a U-shape in cross section at an outer peripheral end of one of the first and second box halves 23, 24 in such a way as to wrap an outer peripheral end of the other and an outer peripheral end of the partition 25. A first silencing chamber 27 is defined between the first box half 23 and the partition 25, and a second silencing chamber 28 is defined between the second box half 24 and the partition 25.

Figure 5:
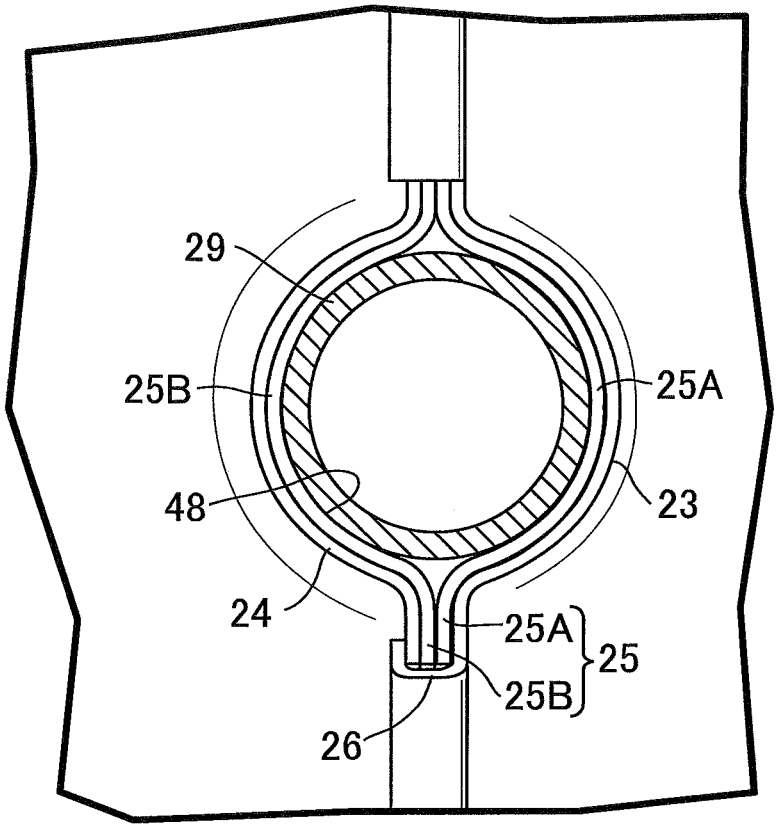
FIG. 5 is a view from an arrow 5 in FIG. 4.

The partition 25 is formed of two partition plates 25A, 25B overlapping each other at their outer peripheral portions. At one spot in the muffler box 22, the swaging piece 26 is cut out and a space between the partition plates 25A, 25B is expanded in a pipe shape (see FIG. 5). An exhaust inlet pipe 29 is inserted, fitted, and welded to an inner peripheral surface 48 of the partition plates 25A, 25B with such an expanded space therebetween. This exhaust inlet pipe 29 and the partition plate 25A on the first silencing chamber 27 side are provided with a communication hole 30 communicating an inside of the exhaust inlet pipe 29 with the first silencing chamber 27. A connection flange 32 is formed at an upstream end of the exhaust inlet pipe 29, and is bolted to a connection flange 31 at a downstream end of the exhaust pipe 5.

Moreover, a pair of supporting bosses 33*a*, 33*b* protruding toward the first and second silencing chambers 27, 28, respectively, and arranged with a gap between the supporting bosses 33*a*, 33*b* are formed in the partition plates 25A, 25B, respectively. These supporting bosses 33*a*, 33*b* support a catalytic converter 34. This catalytic converter 34 includes: a holding tube 36 including an outer tube 36*a* welded to the supporting bosses 33*a*, 33*b* and an inner tube 36*b* welded to opposite ends of the outer tube 36*a* in such a way as to form a heat insulating space 47 between an intermediate portion of the inner tube 36*b* and the outer tube 36*a*; and a three-way catalyst 35 which is fitted on an inner peripheral surface of the inner tube 36*b* and communicates between the first and second silencing chambers 27, 28. Flame arresters 37, 37 having many small holes 38 therein are fitted and welded to inner peripheral surfaces of opposite ends of the inner tube 36*b*, the flame arresters 37, 37 facing each other with the catalyst 35 therebetween.

Further, bulging portions 40*a*, 40*b* are formed in the partition plates 25A, 25B, respectively, the bulging portions 40*a*, 40*b* bulging toward the first and second silencing chambers 27, 28, respectively, to thereby define a third silencing chamber 39 between the bulging portions 40*a*, 40*b*. The bulging portion 40*b* on the second silencing chamber 28 side is provided with multiple silencing holes 41 communicating between the second silencing chamber 28 and the third silencing chamber 39.

Moreover, a tailpipe supporting tube 42 is bridged between and welded to the bulging portion 40*a* on the first silencing chamber 27 side and the first box half 23. Opposite ends of the tailpipe 43 are welded to this tailpipe supporting tube 42, the tailpipe 43 penetrating a center of the tailpipe supporting tube 42 and opening the third silencing chamber 39 to atmosphere. Many silencing holes 44 are bored in a peripheral wall of the tailpipe 43, and a sound absorbing material 45 is filled in the tailpipe supporting tube 42, the sound absorbing material 45 surrounding the tailpipe 43 in such a way as to face the silencing holes 44. Moreover, a heat insulating and sound absorbing material 46 is adhered to inner surfaces of the first and second box halves 23, 24, respectively, the heat insulating and sound absorbing material 46 facing the first and second silencing chambers 27, 28, respectively.

Next, operations of this embodiment will be described.

When the engine E is in operation, exhaust gas discharged from a combustion chamber thereof into the exhaust pipe 5 passes through an inside of the muffler 6 as follows. Specifically, the exhaust gas passes through the exhaust inlet pipe 29, the communication hole 30, the first silencing chamber 27, the catalyst 35, the second silencing chamber 28, the silencing holes 41, the third silencing chamber 39, and the tailpipe 43 in this order to thereby reduce noise, and is then discharged to the atmosphere. In the meantime, in the catalyst 35, HC and $CO_2$ in the exhaust gas are purified through oxidative reaction and NOx in the exhaust gas is purified through reductive reaction. In order to facilitate these purifying reactions, the exhaust pulsation of the engine E is utilized to supply secondary air into the exhaust gas as follows.

When the positive pressure of the exhaust pulsation that occurs inside the exhaust pipe 5 in an exhaust stroke of the engine E is transmitted through the secondary-air introducing pipe 10 to the one-way valve 11, the one-way valve 11 closes, thereby preventing transmission of the positive pressure to the air filter 12 side. Then, when the negative pressure of the exhaust pulsation is transmitted through the secondary-air introducing pipe 10 to the one-way valve 11, the one-way valve 11 opens, thereby transmitting the negative pressure to the air filter 12. As a result, atmospheric air is drawn into and filtered by the air filter 12, sucked into the exhaust pipe 5 through the one-way valve 11 and the secondary-air introducing pipe 10, well mixed with the exhaust gas inside the first silencing chamber 27, and then supplied to the catalyst 35. In this way, the aforementioned purifying reactions can be facilitated effectively.

Even if a flame is generated in the catalyst 35 due to the purifying reactions, the flame can be kept within the catalytic converter 34 since the pair of flame arresters 37 are disposed facing each other with the catalyst 35 therebetween.

Here, the secondary air to be mixed with the exhaust gas is filtered by the exclusive air filter 12 independent of the air cleaner 8 of the engine E. In this way, intake pulsation and the exhaust pulsation of the engine E are prevented from interfering with each other, thereby making it possible to exhibit sufficient output performance utilizing the intake pulsation of the engine E and its inertial effect, and also to reliably perform supply of the secondary air to the exhaust gas utilizing the exhaust pulsation.

Moreover, the air filter 12 is disposed between the crankcase 1 of the engine E and the lower surface of the cylinder block 2 of the engine E. Thus, the space between the crankcase 1 of the engine E and the lower surface of the cylinder block 2 of the engine E, which is originally a dead space, can be utilized effectively for installation of the air filter 12. Accordingly, it is possible to suppress increase in an outer size of the whole engine E caused by the installation.

Furthermore, there is a relatively long distance between the one-way valve 11, which is provided to the air filter 12 disposed below the cylinder block 2, and the exhaust pipe 5 connected to the cylinder head 3, and the secondary-air introducing pipe 10 connecting the one-way valve 11 and the exhaust pipe 5 is routed in such a way as to meander over the one side of the cylinder block 2. Thus, an entire length of the secondary-air introducing pipe 10 can surely be long enough. In this way, intake inertia of the secondary air by the negative pressure is utilized effectively, thereby making it possible to reliably perform the supply of the secondary air into the exhaust gas. Accordingly, the purifying reactions in the catalyst 35 can be performed more effectively. Moreover, routing the secondary-air introducing pipe 10 over the one side of the cylinder block 2 also contributes to the suppression of the increase in the outer size of the whole engine E.

Even if the one-way valve 11 experiences a failure and remains opened, hence allowing the exhaust gas to enter the air filter 12 side through the secondary-air introducing pipe 10 and be discharged to the atmosphere through the air inlets 12*a* in the air filter 12, the exhaust gas discharged through the air inlets 12*a* does not touch any object since the air inlets 12*a* face in the same direction as the exhaust outlet in the tailpipe 43 of the muffler 6, and usually no object is disposed in such a way as to face and block the exhaust outlet in the muffler 6.

Moreover, when the exhaust gas enters the one-way valve 11 side and excessively heats the one-way valve 11 to or above a predetermined temperature, the temperature sensor 18 installed on the one-way valve 11 or in the vicinity thereof is actuated to stop the operation of the engine E. Accordingly, failures of peripheral components due to the excessive heating can be prevented.

After the operation of the engine E is stopped, condensation occurs on the inner wall of the secondary-air introducing pipe 10 and droplets of water formed by the condensation run down to and accumulate on the one-way valve 11. In this case, the drain port 19 may be opened, so that the water can be released to the outside.

In the muffler 6, the muffler box 22 is formed by joining the outer peripheral ends of the three parts, the first and second box halves 23, 24 with their open surfaces abutting each other and the single partition 25 interposed between these first and second box halves 23, 24. The first silencing chamber 27 communicating with the exhaust inlet pipe 29 is defined between the first box half 23 and the partition 25, and the second silencing chamber 28 communicating with the tailpipe 43 is defined between the second box half 24 and the partition 25. The pair of supporting bosses 33*a*, 33*b* protruding toward the first and second silencing chambers 27, 28, respectively, and arranged with a gap between the supporting bosses 33*a*, 33*b* are formed in the partition 25, and these supporting bosses 33*a*, 33*b* support the holding tube 36 of the catalytic converter 34 communicating between the first and second silencing chambers 27, 28. Thus, the catalytic converter 34 can be stably supported inside the muffler box 22 with the single partition 25. Accordingly, the muffler 6 equipped with a catalytic converter can be made compact.

Here, the partition 25 includes the pair of partition plates 25A, 25B closely contacting each other at their outer peripheral portions, and the pair of supporting bosses 33*a*, 33*b* are formed in these partition plates 25A, 25B, respectively. Thus, each of the supporting bosses 33*a*, 33*b* can be molded easily when the corresponding partition plate 25A, 25B is a single separated body. Accordingly, the moldability is good. In addition, by joining the holding tube 36 of the catalytic converter 34 to the supporting bosses 33*a*, 33*b* of both partition plates 25A, 25B, the outer peripheral portions of the both partition plates 25A, 25B closely contact each other and form the single partition 25, and this single partition 25 can be easily held and joined between the first and second box halves 23, 24. Accordingly, the manufacturability is improved.

Moreover, the bulging portions 40*a*, 40*b* bulging toward the first and second silencing chambers 27, 28, respectively, and defining the third silencing chamber 39 between the bulging portions 40*a*, 40*b* are formed in the pair of partition plates 25A, 25B, respectively. The bulging portion 40*b* on one side is provided with the many silencing holes 41 communicating between the second and third silencing chambers 28, 39, and an inner end of the tailpipe 43 is opened to the third silencing chamber 39. Accordingly, it is easy to additionally provide the third silencing chamber 39 between the second silencing chamber 28 and the tailpipe 43 and to enhance the silencing effect.

Note that the present invention is not limited to the above-described embodiment, and various design changes can be made without departing from the gist of the present invention. For example, the downstream end portion of the secondary-air introducing pipe 10 can be connected to the exhaust inlet pipe 29 of the muffler 6 as shown in FIG. 1 with a two-dot chain line 10'.

What is claimed is:

1. A muffler equipped with a catalytic converter, comprising:

a muffler box;

an exhaust inlet pipe provided to the muffler box and connected to an exhaust pipe of an engine;

a tailpipe provided to the muffler box and opened to atmosphere; and a catalytic converter disposed in an exhaust path inside the muffler box, the exhaust path communicating between the exhaust inlet pipe and the tailpipe, wherein the muffler box includes a first box half and a second box half and a partition interposed between the first box half and the second box half, outer peripheral ends of the first box half, the second box half and the partition are joined together with open surfaces of the first box half and the second box half abutting each other, a first silencing chamber communicating with the exhaust inlet pipe is defined between the first box half and the partition, a second silencing chamber communicating with the tailpipe is defined between the second box half and the partition, the partition includes a pair of supporting bosses protruding toward the first and second silencing chambers, respectively, and arranged with a gap between the supporting bosses, the catalytic converter communicating between the first and second silencing chambers and including a holding tube, the supporting bosses support the holding tube of the catalytic converter, wherein the partition includes a pair of partition plates closely contacting each other at outer peripheral portions thereof, each of the partition plates includes corresponding one of the pair of supporting bosses formed therein, the pair of partition plates are partially separated from each other and expanded to define a space of a pipe shape between the partition plates and the exhaust inlet pipe is inserted and fitted into the space.

2. The muffler with a catalytic converter according to claim 1, wherein the pair of partition plates includes bulging portions, one of the bulging portions bulging toward the first silencing chamber and the other of the bulging portions bulging toward the second silencing chamber to define a third silencing chamber between the bulging portions, the other of the bulging portions is provided with a plurality of silencing holes communicating between the second and third silencing chambers, and the tailpipe includes an inner end opened to the third silencing chamber.

3. The muffler with a catalytic converter according to claim 1, wherein the holding tube of the catalytic converter includes flame arresters attached to opposite end portions of the holding tube, the flame arresters facing each other with a catalyst in the catalytic converter situated between the flame arresters.

4. The muffler with a catalytic converter according to claim 1, wherein secondary air supplied into any one of the exhaust pipe and the exhaust inlet pipe is mixed with exhaust gas in the first silencing chamber so as to facilitate an exhaust gas purifying reaction in the catalytic converter.

5. The muffler with a catalytic converter according to claim 4, wherein the catalytic converter is disposed between the first and second silencing chambers such that an exhaust gas flows from the first silencing chamber to the second silencing chamber through the catalytic converter.

6. The muffler with a catalytic converter according to claim 1, wherein the outer peripheral portions of the pair of partition plates are further joined to the outer peripheral ends of the first box half and the second box half.

7. The muffler with a catalytic converter according to claim 1, wherein the pair of partition plates are forked into two branches at an inner end thereof, and the supporting bosses are provided at respective ends of the branches.

8. The muffler with a catalytic converter according to claim 7, wherein the supporting bosses are connected to a surface of the holding tube of the catalytic converter.

9. The muffler with a catalytic converter according to claim 2, wherein the third silencing chamber is disposed between the first silencing chamber and the second silencing chamber, and the first silencing chamber and the third silencing chamber are partitioned by the one of the bulging portions, and the second silencing chamber and the third silencing chamber are partitioned by the other of the bulging portions.

* * * * *